US010987786B2

(12) United States Patent
Hsieh

(10) Patent No.: US 10,987,786 B2
(45) Date of Patent: Apr. 27, 2021

(54) TORQUE WRENCH WITH TORQUE ADJUSTMENT MECHANISM

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 304 days.

(21) Appl. No.: 16/260,626

(22) Filed: Jan. 29, 2019

(65) Prior Publication Data

US 2019/0299377 A1 Oct. 3, 2019

(30) Foreign Application Priority Data

Apr. 2, 2018 (TW) ..... 107111577

(51) Int. Cl.
*B25B 23/142* (2006.01)

(52) U.S. Cl.
CPC ..... *B25B 23/1427* (2013.01)

(58) Field of Classification Search
CPC ..... B25B 23/1427; B25B 23/142; B25B 23/1422; B25B 23/1425
USPC ..... 81/467, 478, 481, 482, 483
See application file for complete search history.

(56) References Cited

U.S. PATENT DOCUMENTS 3,772,942 A * 11/1973 Grabovac ..... B25B 23/1427 81/483
4,467,678 A * 8/1984 Lindholm ..... B25G 1/043 81/483
8,495,935 B2 * 7/2013 Mountz ..... G01L 5/24 81/467

* cited by examiner

*Primary Examiner* — Monica S Carter
*Assistant Examiner* — Alberto Saenz
(74) *Attorney, Agent, or Firm* — Guice Patents PLLC

(57) ABSTRACT

A torque wrench with torque adjustment mechanism includes a tubular body and a torque adjustment mechanism disposed in the tubular body. The torque adjustment mechanism includes an abutting member, an adjustment member and an adjustment button. The abutting member has a first slope disposed at rear end of the abutting member in contact with a second slope disposed at a front end of the adjustment member. When adjusting the set torque value of the torque wrench, the adjustment button is rotated to drive the adjustment member to displace in a transverse direction of the tubular body. By means of the cooperation between the first and second slopes, the abutting member is displaced in a longitudinal direction of the tubular body to compress or release an elastic member positioned in front of the abutting member.

10 Claims, 5 Drawing Sheets

TORQUE WRENCH WITH TORQUE ADJUSTMENT MECHANISM

BACKGROUND OF THE INVENTION

1. Field of the Invention

The present invention relates generally to a wrench, and more particularly to a torque wrench with a novel torque adjustment mechanism.

2. Description of the Related Art

It is known that in the relevant field, the torque wrench is one of the most frequently used hand tools and is widely used in various working sites for tightening/untightening a threaded member. The torque value of the torque wrench is previously set so as to control the tightening extent of the threaded member. Especially to a special or important facilities or apparatus such as a bridge, an airplane or various vehicles, the structures of the components of the apparatus necessitate precise and correct tightening extent, therefore, the torque value of the torque wrench is preset to tighten the components of the apparatus in accordance with the necessary mechanical properties of the apparatus so as to meet the security regulation and ensure the safety in use of the facilities or apparatus.

The conventional torque wrenches can be substantially classified into two types, that is, electronic torque wrench and mechanical torque wrench. With respect to the mechanical torque wrench, a torque adjustment mechanism is used to compress or release an elastic member so as to adjust the set torque value of the torque wrench so that the torque wrench can be used to precisely and correctly tighten/untighten various threaded members.

The mechanical torque wrench has been developed long since so that the existent mechanical torque wrench has fixed internal structure. For example, the torque value of the current mechanical torque wrench is generally adjusted in such a manner that the handle of the torque wrench is rotated to back and forth displace a block body drivingly connected with the handle so as to compressor release the elastic member for adjusting the torque value of the torque wrench. However, such conventional adjustment structure is not novel and inventive. As a result, the torque wrench cannot be further developed and improved.

SUMMARY OF THE INVENTION

It is therefore a primary object of the present invention to provide a torque wrench with a novel torque adjustment mechanism.

It is a further object of the present invention to provide the above torque wrench with the novel torque adjustment mechanism, which enables a user to directly and quickly know the torque value of the torque wrench.

It is still a further object of the present invention to provide the above torque wrench with the novel torque adjustment mechanism, which can be stably used.

To achieve the above and other objects, the torque wrench with torque adjustment mechanism of the present invention includes:

a tubular body having a passage formed in the tubular body;

a working head disposed at a front end of the tubular body, a rear end of the working head being positioned in the passage of the tubular body;

a click mechanism positioned behind the working head in contact with the rear end of the working head;

an elastic member disposed in the passage of the tubular body, a front end of the elastic member applying an elastic force to the click mechanism; and a torque adjustment mechanism including an abutting member, an adjustment member and an adjustment button, the abutting member having a first slope disposed on a rear end face of the abutting member; the adjustment member having a second slope disposed on a front end face of the adjustment member corresponding to the first slope of the abutting member, the adjustment member being positioned behind the abutting member with the second slope attaching to the first slope of the abutting member; the adjustment button serving to drive the adjustment member to displace within the tubular body in the transverse direction thereof; a rear end of the elastic member applying an elastic force to the torque adjustment mechanism.

Whereby when the adjustment member displaces in the transverse direction of the tubular body, the abutting member is driven to displace within the tubular body in the longitudinal direction thereof to compress or release the elastic member, so as to adjust the set torque value of the torque wrench.

Preferably, the adjustment button of the torque adjustment mechanism has a stem body transversely passing through the tubular body. The adjustment member is further formed with a threaded hole. The adjustment button is screwed in the threaded hole of the adjustment member, whereby when the adjustment button is rotated, the adjustment member is displaced within the tubular body in the transverse direction thereof.

Preferably, the tubular body further has a window disposed on a wall of the tubular body and a torque display mechanism having a gear and a scale disc. The gear is fitted on the stem body of the adjustment button and rotatable with the stem body. The scale disc has scales disposed on one face of the scale disc. The scale disc is disposed on one side of the adjustment member and pivotally connected with an inner wall face of the tubular body with the scales displayed through the window of the tubular body. The scale disc is engaged with the gear, whereby when the gear is rotated, the scale disc is rotated with the gear.

Accordingly, the structure of the torque adjustment mechanism of the present invention is not only novel, but also can be used to adjust the torque value of the torque wrench. In addition, from the scale of the scale disc displayed through the window of the tubular body, a user can directly and quickly know the currently set torque value of the torque wrench. Therefore, the convenience in use of the torque wrench and the utility of the torque wrench are enhanced.

The present invention can be best understood through the following description and accompanying drawings, wherein:

DETAILED DESCRIPTION OF THE PREFERRED EMBODIMENTS

Figure 1:
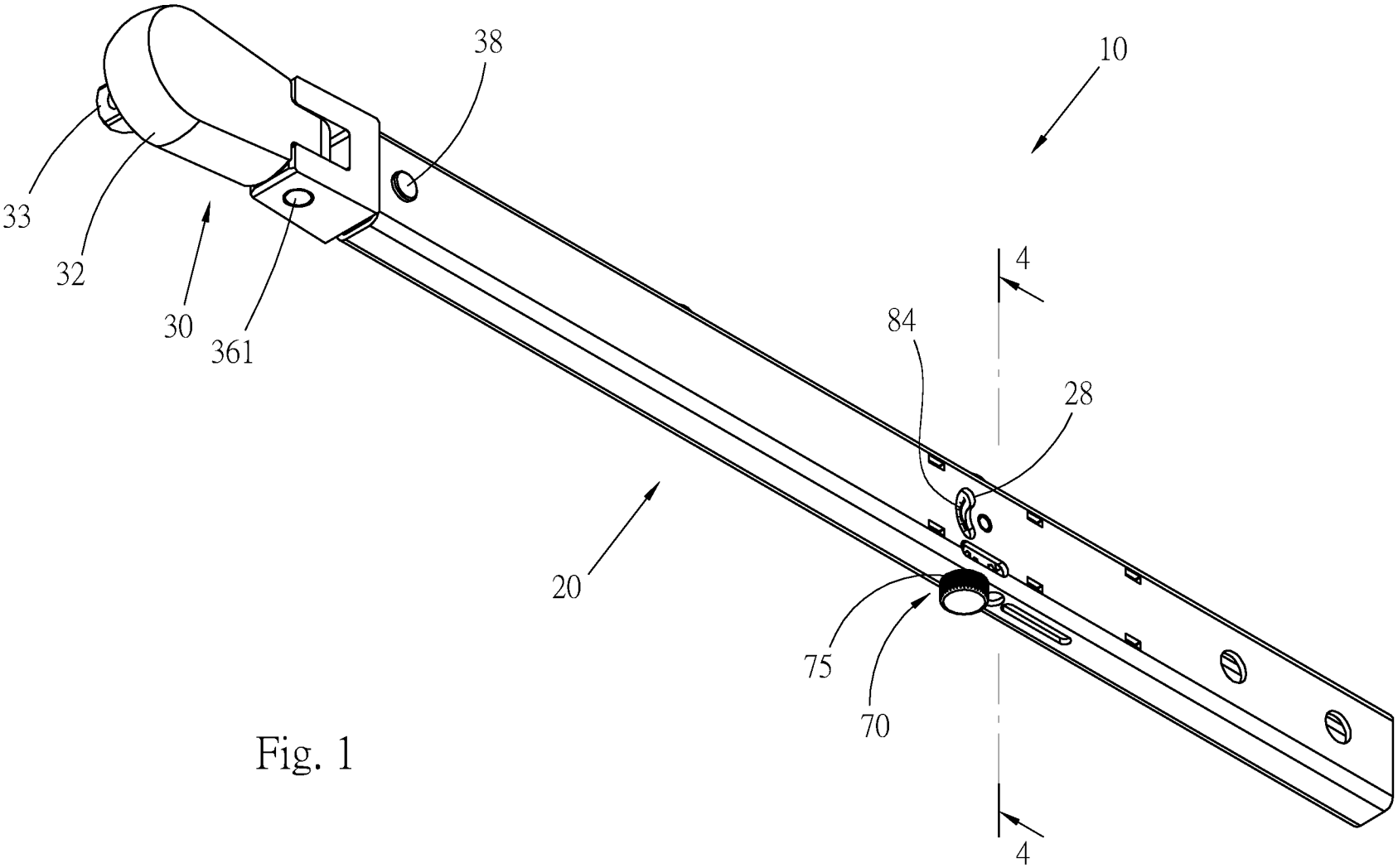
FIG. 1 is a perspective assembled view of a preferred embodiment of the torque wrench with torque adjustment mechanism of the present invention.
Figure 2:
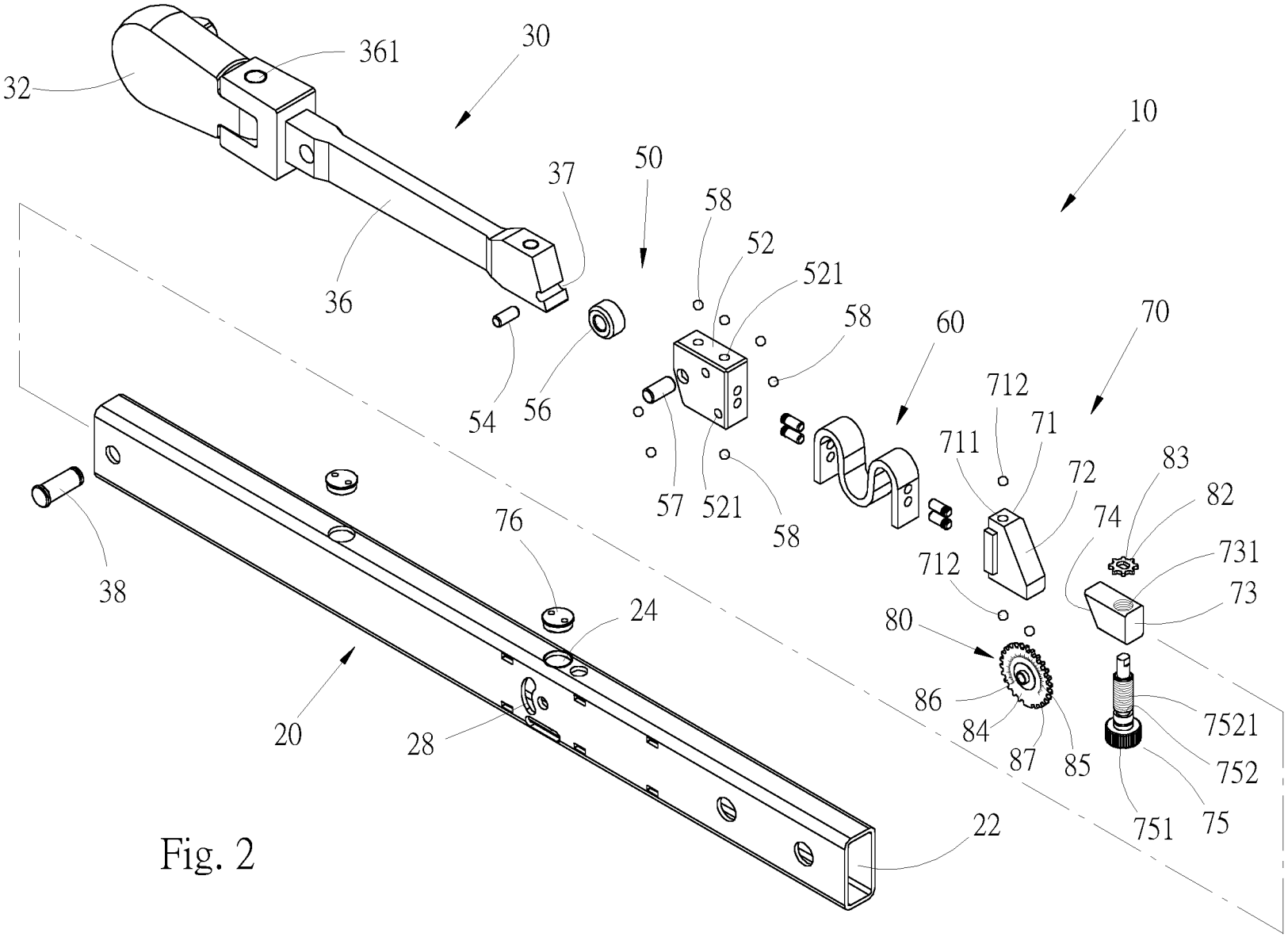
FIG. 2 is a perspective generally exploded view of the preferred embodiment of the torque wrench of the present invention according to FIG. 1.
Figure 3:
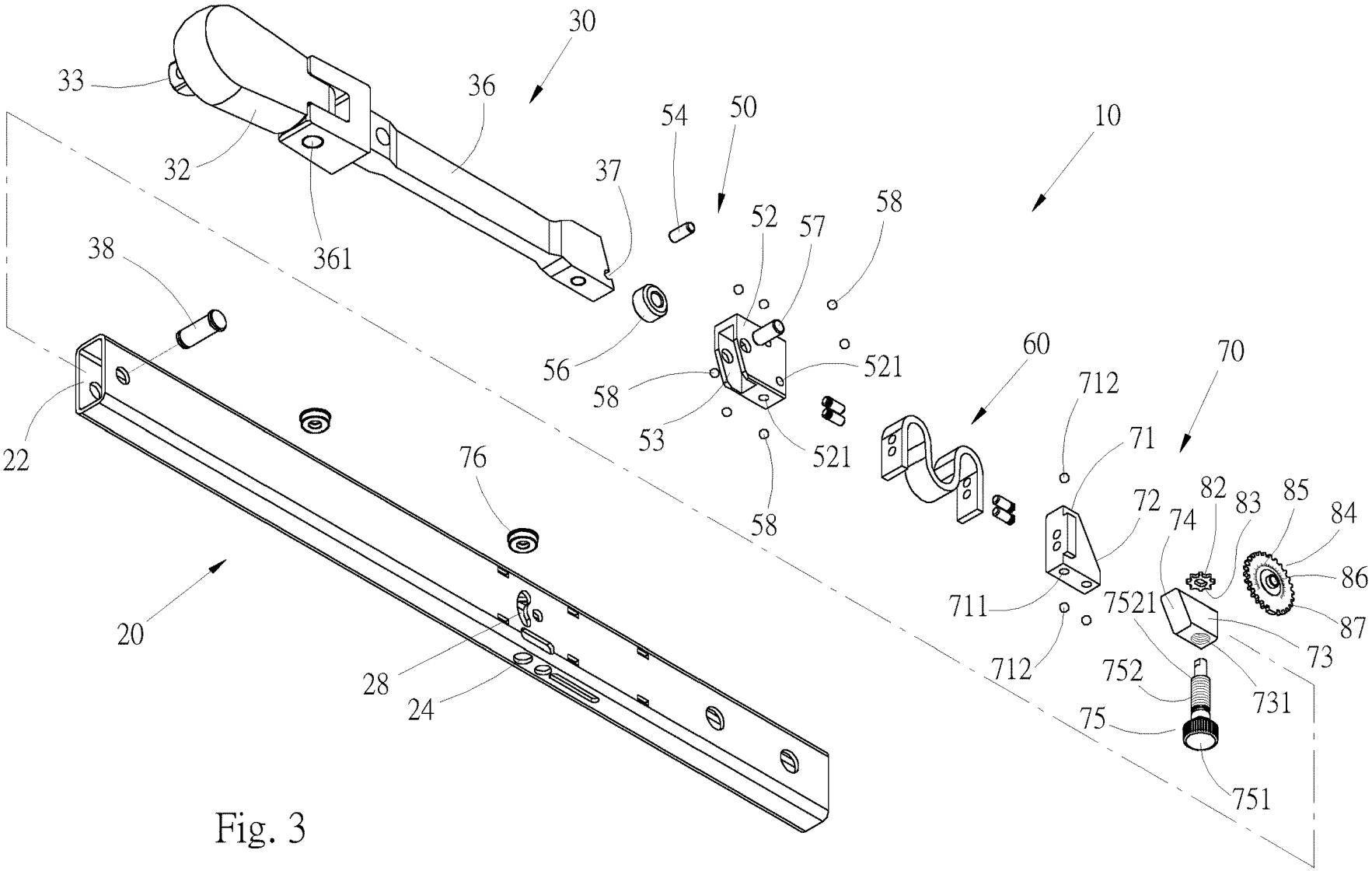
FIG. 3 is a perspective generally exploded view of the preferred embodiment of the torque wrench of the present invention according to FIG. 2, seen in another direction.
Figure 4:
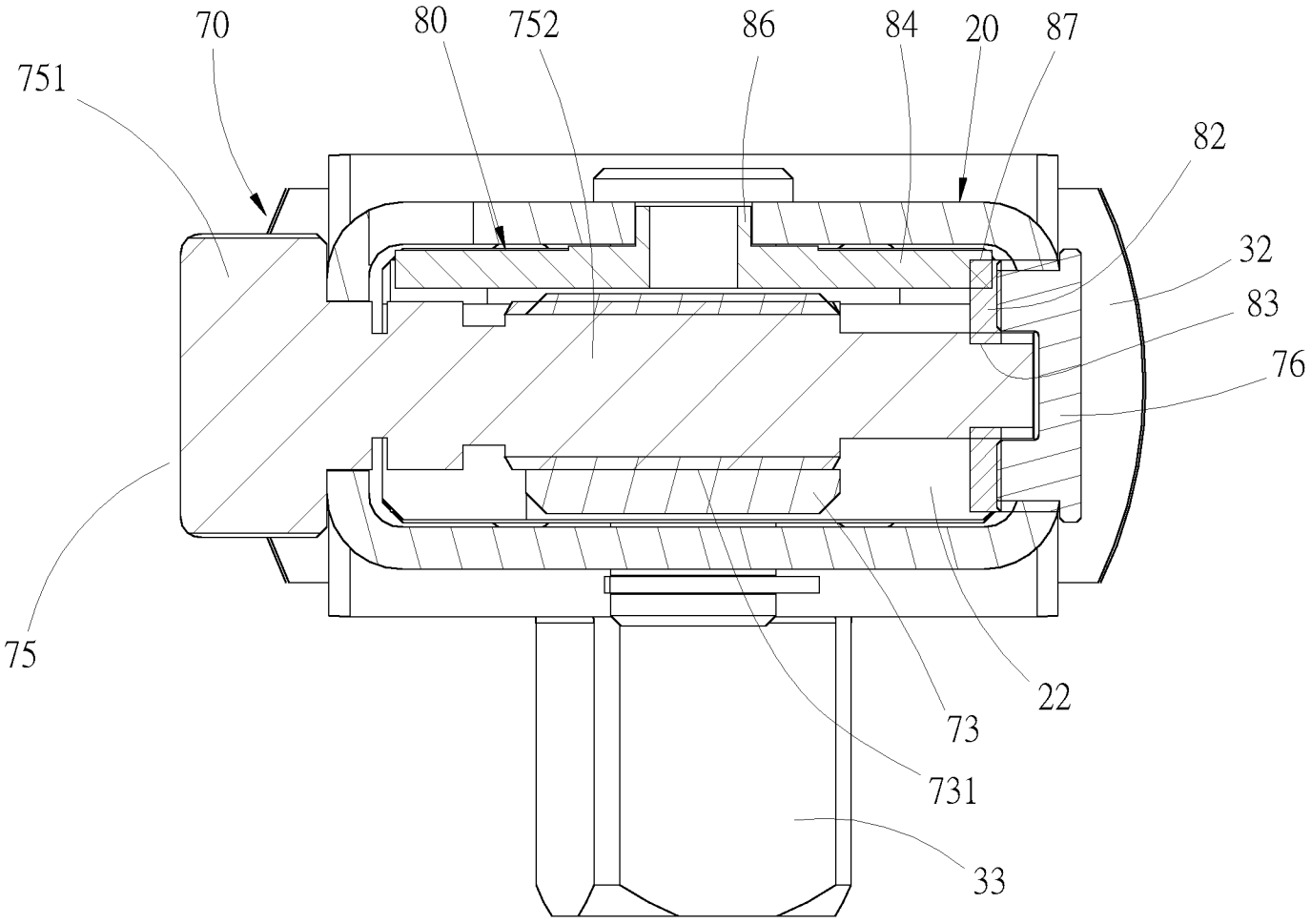
FIG. 4 is a sectional view taken along line 4-4 of FIG. 1.

Please refer to FIGS. 1 to 5, which show a preferred embodiment of the torque wrench 10 with torque adjustment mechanism of the present invention. In order to facilitate understanding of the technical content of the present invention, the front, rear, left, right, top and bottom sides referred to hereinafter are recited with reference to the direction of FIG. 1. The torque wrench 10 includes a tubular body 20, a working head 30, a click mechanism 50, an elastic member 60 and a torque adjustment mechanism 70.

In this embodiment, the tubular body 20 has a rectangular cross section with a longitudinal direction and a transverse direction. The longitudinal direction is defined between two ends of the tubular body, while the transverse direction is defined between two sides of the tubular body. The tubular body includes a passage 22, a perforation 24 and a window 28. The passage 22 is a rectangular passage extending through the tubular body 20 in the longitudinal direction of the tubular body 20 between two ends thereof. The perforation 24 is formed through two sidewalls of the tubular body 20 in communication with the passage 22. In this embodiment, the window 28 is an arched hole disposed on the top wall of the tubular body 20 in communication with the passage 22. The window 28 is positioned in front of the perforation 24.

The working head 30 includes a head section 32 and a stem section 36. The head section 32 of the working head 30 is for driving a work piece. In this embodiment, the head section 32 has an insertion column 33 for fitting with a socket for driving a threaded member (a bolt or a nut). The head section can have an otherwise form, for example, but not limited to, a polygonal socket for fitting with a threaded member. The stem section 36 is disposed behind the head section 32. A front end of the stem section 36 is pivotally connected with a rear end of the head section 32 via a pivot shaft 361, whereby the head section 32 can rotate around the pivot shaft 361. The working head 30 is disposed at the front end of the tubular body 20. The stem section 36 is fitted into the passage 22 of the tubular body 20 and pivotally connected with the tubular body 20 via a shaft pin 38 with the head section 32 protruding from the front end of the tubular body 20.

Figure 5:
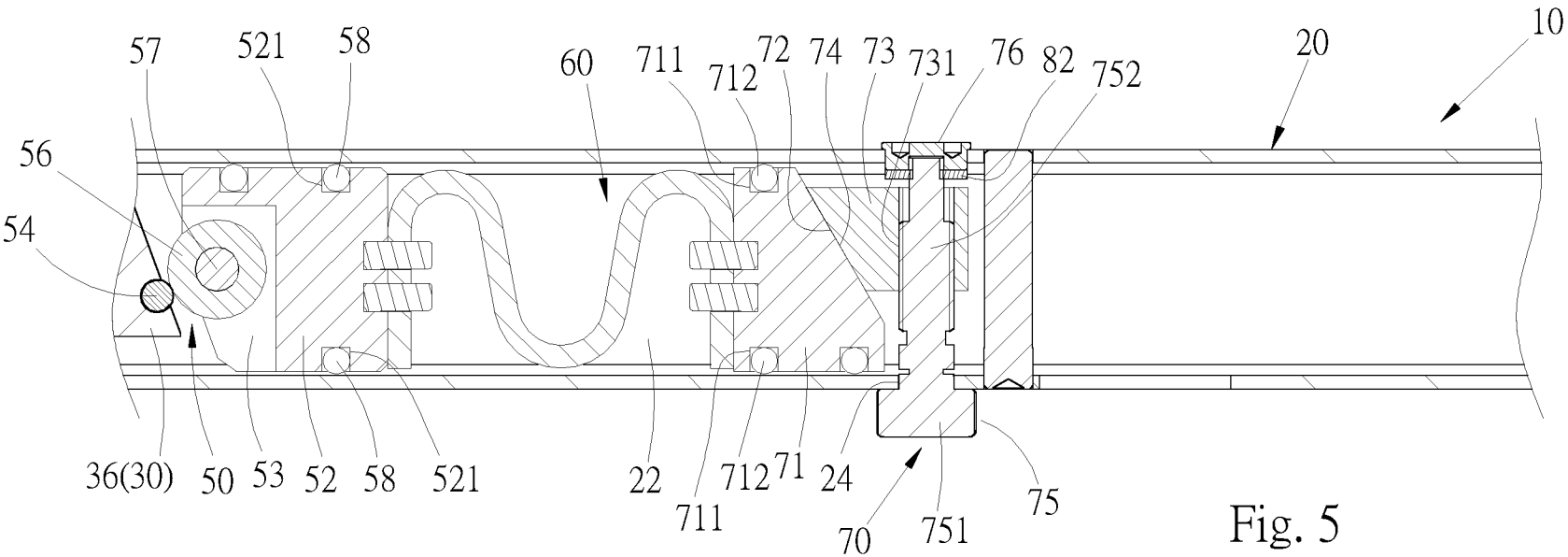
FIGS. 5 and 6 are longitudinally sectional views of the preferred embodiment of the torque wrench of the present invention according to FIG. 1, showing that the torque value of the torque wrench is adjusted by the torque adjustment mechanism.

The click mechanism 50 is disposed in the passage 22 and positioned at the rear end of the stem section 36 of the working head 30. Under an elastic force of the elastic member 60, the click mechanism 50 is in elastic contact with the stem section 36 as described hereinafter. When the applied force of the wrench exceeds a set torque value, the click mechanism 50 will provide a warning for a user. The click mechanism 50 can have different forms. This embodiment only discloses one form of click mechanism and is not intended to limit the form of the click mechanism 50. In this embodiment, the click mechanism 50 includes a base 52, an abutment member 54 and a roller 56. The abutment member 54 has a cylindrical form and is disposed in a notch 37 of the stem section 36 to partially protrude from the rear end of the stem section 36. The roller 56 is pivotally connected in a cavity 53 of the front end of the base 52 via a pivot shaft 57 to slightly protrude from the front end of the base 52. Accordingly, in normal state, the abutment member 54 abuts against one side of the roller 56. When the wrench reaches the set torque value, the stem section 36 of the working head 30 will laterally deflect to make the click mechanism 50 click to notify a user, whereby the abutment member 54 passes over the foremost end of the roller 56 to abut against the other side of the roller 56. In addition, several ball members 58 are disposed on the periphery of the base 52 to partially protrude from the base 52. In this embodiment, totally seven receiving dents 521 are disposed on two lateral sides and top side and bottom side of the base 52 and seven ball members 58 are respectively received in the receiving dents 521. Accordingly, as shown in FIG. 5, several ball members 58 of the two lateral sides of the base 52 respectively contact the inner wall faces of two sides of the tubular body 20. Also, several ball members of the top and bottom sides of the base contact the inner wall faces of the top and bottom walls of the tubular body 20. Under such circumstance, when the base 52 displaces within the tubular body 20, the frictional force against the base 52 is reduced.

The elastic member 60 is disposed in the passage 22 of the tubular body 20 and positioned behind the click mechanism 50. A front end of the elastic member applies elastic force to the rear end of the click mechanism 50. The elastic member employed in the present invention can have various forms such as a conventional coiled spring. This embodiment only discloses one form of elastic member and is not intended to limit the form of the elastic member.

The torque adjustment mechanism 70 is disposed in the passage 22 of the tubular body 20 and positioned behind the elastic member 60. The torque adjustment mechanism 70 includes an abutting member 71, an adjustment member 73, an adjustment button 75 and an outer cap 76. The abutting member 71 has a substantially rectangular cross section in adaptation to the configuration of the tubular body 20. The abutting member 71 has a first slope 72 disposed on a rear end face of the abutting member 71. At least two receiving dents 711 are respectively disposed on two lateral sides of the abutting member 71. In this embodiment, there are three receiving dents 711. Several ball members 712, for example, three ball members, are respectively mounted in the receiving dents 711 to slightly protrude from the two lateral sides of the abutting member 71. Under such circumstance, when the abutting member 71 displaces within the passage 22, the ball members 712 contact the inner wall face of the tubular body 20 so as to reduce the frictional force between the abutting member 71 and the tubular body. A rear end of the elastic member 60 applies elastic force to a front end face of the abutting member 71.

The adjustment member 73 also has a substantially rectangular cross section in adaptation to the configuration of the tubular body 20. The adjustment member 73 has a threaded hole 731 and a second slope 74 disposed on a front end face of the adjustment member 73. The threaded hole 731 transversely passes through the adjustment member 73. The adjustment member 73 is positioned behind the abutting member 71 with the second slope 74 attaching to the first slope 72 of the abutting member 71. The adjustment button 75 includes a head section 751 and a stem body 752. One end of the stem body 752 is connected with the head section 751. The stem body 752 is formed with a thread 7521. The adjustment button 75 passes through the perforation 24 of the tubular body 20 and is rotatable within the perforation 24. The head section 751 is positioned outside a sidewall of the tubular body 20. The thread 7521 of the stem body 752 is screwed in the threaded hole 731 of the adjustment member 73. The outer cap 76 is disposed at the other end of the perforation 24.

Please refer to FIGS. 1 to 4, the torque wrench 10 further includes a torque display mechanism 80 including a gear 82 and a scale disc 84. The gear 82 is positioned on an inner wall face of a sidewall of the tubular body 20. A free end of the stem body 752 of the adjustment button 75 is fitted through a hole 83 of the gear 82, whereby the gear 82 is drivable by the adjustment button 75 to rotate therewith. The surface of the scale disc 84 is marked with scales 85. In this embodiment, the scales 85 are torque values. The scale disc 84 is pivotally rotatably disposed on the inner wall face of the top wall of the tubular body 20 via a pivot shaft 86. The scale disc 84 has a toothed section 87 along the circumference for engaging with the gear 82. Accordingly, the scale disc 84 is drivable by the gear 82 to rotate, whereby a user can observe the displayed scale of the scale disc 84 through the window 28 of the tubular body 20 as shown in FIG. 1.

Figure 6:
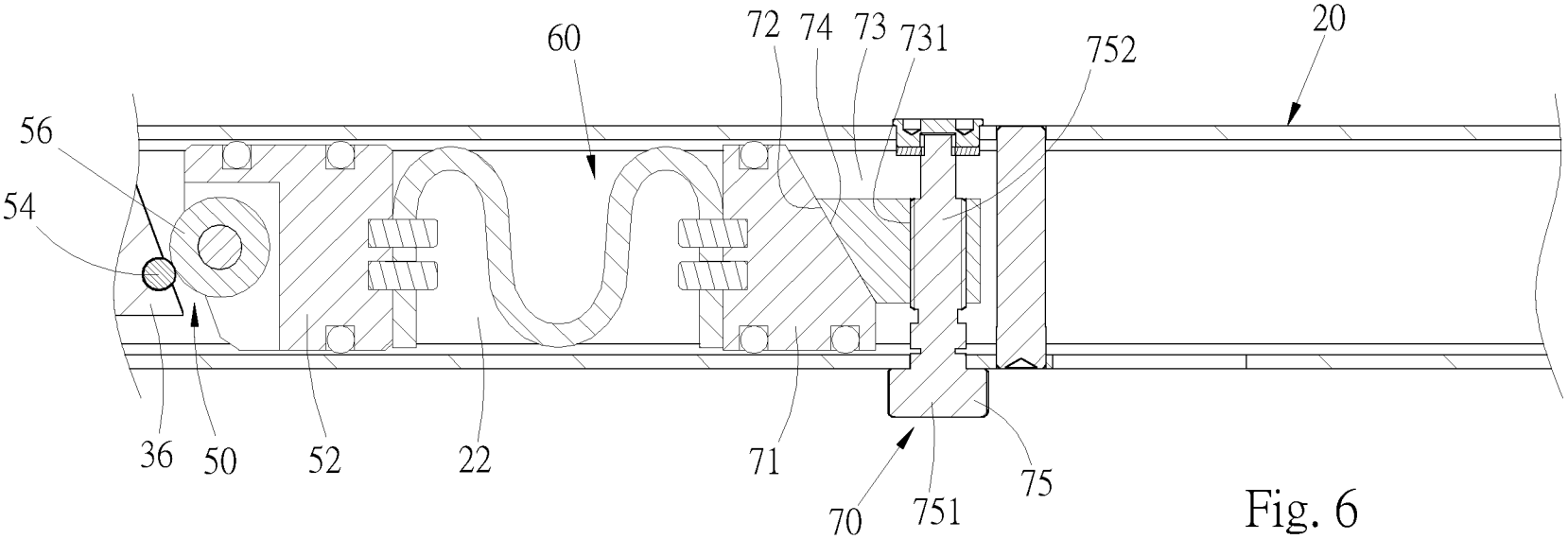

When adjusting the torque value of the torque wrench 10, a user rotates the adjustment button 75 of the torque adjustment mechanism 70 to make the stem body 752 of the adjustment button 75 rotate. The adjustment member 73 has a substantially rectangular configuration in adaptation to the configuration of the tubular body 20 so that it is impossible for the adjustment member 73 to rotate or spin within the passage 22, therefore, when the adjustment button 75 is rotated, adjustment member 73 is driven to displace within the tubular body 20 in the transverse direction thereof. Furthermore, as shown in FIGS. 5 and 6, by means of the inclination design of the first and second slopes 72, 74, when the adjustment member 73 transversely displaces toward one side of the tubular body 20, for example, toward the head section 751 of the adjustment button 75 as shown in FIG. 6, the abutting member 71 is gradually pushed forward by the adjustment member 73 to compress the elastic member 60 and increase the elastic energy thereof. Reversely, when the adjustment member 73 transversely displaces toward the other side of the tubular body 20, for example, toward the free end of the adjustment button 75 as shown in FIG. 5, the abutting member 71 is gradually released from the push of the adjustment member 73, whereby the abutting member 71 displaces toward the rear end of the tubular body 20 to release the elastic member 60 and decrease the elastic energy thereof. Accordingly, when the adjustment member 73 transversely displaces, the abutting member 71 is driven to move back and forth in the longitudinal direction of the tubular body 20 to compress or release the elastic member 60 so as to adjust the torque value of the torque wrench 10.

When the adjustment button 75 is rotated, the gear 82 is driven to rotate. The toothed section 87 of the scale disc 84 is engaged with the gear 82 so that when the gear 82 is rotated, the scale disc 84 is rotated therewith to change the scale 85 displayed in the window 28 of the tubular body 20. Accordingly, a user can directly and quickly know the currently set torque value of the torque wrench 10.

Please refer to FIG. 5, when the adjustment member 73 is positioned at a dead end, the abutting member 71 will not forward compress the elastic member 60 so that the elastic member 60 extends rearward and the abutting member 71 is displaced rearward under the elastic force of the elastic member 60. At this time, the elastic member 60 with less elastic energy applies a smaller elastic force to the click mechanism 50. Please further refer to FIG. 6, when the adjustment button 75 is rotated to make the adjustment member 73 gradually displace to another dead end as shown in FIG. 6, the second slope 74 of the adjustment member 73 attaches to the first slope 72 of the abutting member 71 and moves along the first slope 72, whereby the abutting member 71 is pushed to gradually move forward and compress the elastic member 60. At this time, the elastic member 60 with greater elastic energy applies a greater elastic force to the click mechanism 50 so as to change the set torque value of the torque wrench 10.

Please further refer to FIGS. 1 to 4. When the adjustment button 75 is rotated, the scale disc 84 is rotated along with the rotation of the gear 82 so as to change the scale 85 displayed in the window 28 of the tubular body 20. Accordingly, from the scale 85, a user can directly and quickly know the set torque value of the torque wrench 10. Therefore, the convenience in use of the torque wrench 10 is enhanced.

The structure of the torque adjustment mechanism of the present invention is not only novel, but also can be stably used. The torque adjustment mechanism can truly compress or release the elastic member so as to truly adjust the set torque value of the torque wrench and ensure the utility of the torque wrench. Moreover, from the scale of the scale disc displayed through the window of the tubular body, a user can directly and quickly know the set torque value of the torque wrench. Therefore, the user can precisely adjust the torque value of the torque wrench to a necessary torque value. This enhances the utility of the torque wrench.

The above embodiments are only used to illustrate the present invention, not intended to limit the scope thereof. Many modifications of the above embodiments can be made without departing from the spirit of the present invention.

What is claimed is:

1. A torque wrench with torque adjustment mechanism, comprising:

a tubular body defined with a longitudinal direction and a transverse direction, the tubular body having a passage extending through the tubular body in the longitudinal direction of the tubular body;

a working head disposed at a front end of the tubular body, a rear end of the working head being positioned in the passage of the tubular body;

a click mechanism positioned behind the working head in contact with the rear end of the working head;

an elastic member disposed in the passage of the tubular body, a front end of the elastic member applying an elastic force to the click mechanism; and a torque adjustment mechanism being disposed in the tubular body and including an abutting member, an adjustment member and an adjustment button, the abutting member having a first slope disposed on a rear end face of the abut ting member; the adjustment member having a second slope disposed on a front end face of the adjustment member corresponding to the first slope of the abutting member, the adjustment member being positioned behind the abutting member with the second slope attaching to the first slope of the abutting member; the adjustment button serving to drive the adjustment member to displace within the tubular body in the transverse direction thereof; the elastic member being positioned between the click mechanism and the abutting member of the torque adjustment mechanism;

whereby when the adjustment member displaces in the transverse direction of the tubular body, the abutting member is driven to displace within the tubular body in the longitudinal direction thereof to compress or release the elastic member.

2. The torque wrench as claimed in claim 1, wherein the adjustment button is transversely disposed in the tubular body and connected with the adjustment member.

3. The torque wrench as claimed in claim 1, wherein the adjustment button has a stem body transversely passing through the tubular body; the adjustment member being formed with a threaded hole, the adjustment button being screwed in the threaded hole of the adjustment member, whereby when the adjustment button is rotated, the adjustment member is displaced within the tubular body in the transverse direction thereof.

4. The torque wrench as claimed in claim 1, wherein the tubular body further includes a perforation formed through the tubular body in the transverse direction thereof in communication with the passage; the adjustment button having a stem body, a thread being formed on an outer circumference of the stem body, the adjustment button being passed through the perforation of the tubular body and the stem body received in the tubular body; the adjustment member further having a threaded hole formed through the adjustment member in a transverse direction thereof; the stem body of the adjustment button being screwed in the threaded hole of the adjustment member; whereby when the stem body is rotated, the adjustment member is driven to displaced within the tubular body in the transverse direction thereof.

5. The torque wrench as claimed in claim 4, wherein the adjustment button of the torque adjustment mechanism further has a head section connected with one end of the stem body, the head section being protruded outside a sidewall of the tubular body.

6. The torque wrench as claimed in claim 4, wherein the tubular body further has a window disposed on a wall of the tubular body in communication with the passage; the torque wrench further comprising a torque display mechanism having a gear and a scale disc, the gear being rotatable with the stem body, a surface of the scale disc being marked with scales, the scale disc being pivotally rotatably connected on an inner wall face of the tubular body and the scales displayed through the window of the tubular body, the scale disc being engaged with the gear, whereby when the gear is rotated, the scale disc is rotated with the gear.

7. The torque wrench as claimed in claim 1, wherein the tubular body has a rectangular cross section and the adjustment member of the torque adjustment mechanism also has a rectangular cross section.

8. The torque wrench as claimed in claim 7, wherein the abutting member of the torque adjustment mechanism has a substantially rectangular cross section.

9. The torque wrench as claimed in claim 4, wherein the torque adjustment mechanism further includes an outer cap, the outer cap being connected with a free end of the stem body of the adjustment button and positioned at one end of the perforation.

10. The torque wrench as claimed in claim 1, wherein the click mechanism has a base, multiple ball members being disposed on a periphery of the base in contact with an inner wall face of the tubular body; the elastic member applying an elastic force to the base; multiple ball members being disposed on a periphery of the abutting member in contact with the inner wall face of the tubular body.

* * * * *